United States Patent [19]

Miller

[11] 4,350,141

[45] Sep. 21, 1982

[54] BLOW BACK PREVENTION APPARATUS FOR A WOOD-BURNING STOVE

[75] Inventor: Joseph N. Miller, Overland, Mo.

[73] Assignee: Jackes-Evans Manufacturing Company, St. Louis, Mo.

[21] Appl. No.: 34,571

[22] Filed: Apr. 30, 1979

[51] Int. Cl.[3] ..... F23L 3/00; F23M 7/00

[52] U.S. Cl. ..... 126/287; 110/175 R; 126/15 R; 126/77; 126/193

[58] Field of Search ..... 126/285, 286, 287, 77, 126/15 R, 67, 190, 198, 193; 110/175 R, 175 A

[56] References Cited

U.S. PATENT DOCUMENTS

| | | | |
|---|---|---|---|
| 204,406 | 5/1878 | White | 126/287 |
| 472,728 | 4/1892 | Decker | 126/287 |
| 713,066 | 11/1902 | Cooper | 126/287 |
| 760,542 | 5/1904 | March | 126/287 |
| 894,856 | 8/1908 | Roake | 126/287 |
| 1,914,372 | 6/1908 | Hvoslef | 126/287 |
| 2,174,347 | 9/1939 | Card | 126/287 |
| 2,227,689 | 1/1941 | Agricola | 126/287 |
| 2,352,057 | 6/1944 | Wingert | 126/287 |
| 2,443,910 | 6/1948 | Higley | 126/287 |
| 2,506,643 | 5/1950 | Jaye | 110/175 R |
| 4,030,479 | 6/1977 | Webb | 126/287 |

*Primary Examiner*—Daniel J. O'Connor
*Attorney, Agent, or Firm*—Kirkland & Ellis

[57] ABSTRACT

A device for preventing blow back through the fuel loading door in stoves or heaters in which the rate of combustion is controlled by restricting the supply of air to the combustion chamber. When the stove is burning during normal operation the fuel loading door is closed and an air inlet to the combustion chamber is blocked by a pan member of the outer cabinet door. A thermostatic damper controls the rate of combustion in the combustion chamber by restricting the quantity of air supplied via other air intakes. When the outer cabinet door is opened to gain access to the fuel loading door, the pan member on the cabinet door is moved away from the air inlet to the combustion chamber thereby allowing additional air to enter the combustion chamber via the air inlet to the combustion chamber. The additional air supplied via this air inlet increases the rate of combustion prior to the opening of the fuel loading door. This increased combustion rate is unaffected by the opening of the fuel loading door, and the flames, smoke and other products of combustion are not blown back through the fuel loading door when it is opened.

6 Claims, 2 Drawing Figures

BLOW BACK PREVENTION APPARATUS FOR A WOOD-BURNING STOVE

BACKGROUND OF THE INVENTION

1. Field of the Invention

The present invention relates to stoves or heaters, including wood-burning stoves, and more particularly to a device for preventing flames, smoke or other products of combustion from blowing back through the fuel loading door when that door is opened.

2. Description of the Prior Art

Stoves or heaters of the type burning solid fuels such as wood or coal and employing a combustion chamber housing which is enclosed by an outer housing are known in the prior art. The combustion chambers of such stoves have normally included a fuel loading door through which fuel is introduced into the combustion chamber with another door being provided in the outer housing to permit access to the fuel loading door. Stoves and heaters of the foregoing type frequently also include a combustion air inlet having control means for varying the amount of air permitted to enter the combustion chamber. A damper is provided to regulate the inflow of combustion air through the combustion air inlet with the combustion air frequently being largely cut off when the damper is closed; however, the solid fuel and the gases emitted therefrom remain in the combustion chamber and are readily ignitable upon receiving a fresh supply of oxygen. Under these conditions, the opening of the fuel loading door of the combustion chamber results in the rapid admission of air into the combustion chamber causing the gases and solid fuel in the combustion chamber to be immediately ignited and frequently causing flames, smoke and other products of combustion to rapidly blow back through the open fuel loading door.

The prior art discloses devices intended for use in connection with such stoves for preventing flames, smoke and other products of combustion from blowing back through the fuel loading door whenever that door is opened under the above-described conditions. Thus, for example, U.S. Pat. No. 4,030,479, entitled "Solid Fuel Heater With Blowback Prevention Means," issued June 21, 1977, to Webb, discloses an elongated cam member for opening a valving means comprising a pivotable closure member which is used to regulate the flow of air into the combustion chamber. One end of the elongated cam member is pivotably connected to the outer housing door and the other end is operably connected to the closure member. Opening the outer housing door moves the elongated cam member thereby opening the pivotable closure member to admit combustion air so that the subsequent opening of the fuel feed door to the combustion chamber will not result in a rapid inflow of air and the ignition of the products in the combustion chamber to create a "dangerous blowback problem". U.S. Pat. No. 2,352,057, entitled "Safety By-Pass for Stoves and Furnaces," issued June 20, 1944, to Wingert, provides a means for automatically releasing the gases accumulated over a fuel bed into a smoke stack when the fuel feed door is opened. U.S. Pat. No. 713,066, entitled "Damper Mechanism", issued Nov. 11, 1902, to Cooper, discloses a means for opening a damper automatically with the opening of the feed door to the combustion chamber; the Cooper patent does not disclose a means for increasing the air supply to the combustion chamber prior to the opening of the fuel feed door. Other means for moving a damper for the admission of air as the fuel feed door is opened by means of interconnecting linkage are disclosed in U.S. Pat. No. 472,728, entitled "Furnace", issued Apr. 12, 1892, to Decker, et al., and in U.S. Pat. No. 204,406, entitled "Stove Damper", issued May 28, 1978, to White.

All of these prior art devices require interconnecting linkage to actuate a valve or damper, and all of these prior art devices except the Webb device are actuated by the opening of the fuel feed door to the combustion chamber rather than by the outer housing door so that the air supply to the combustion chamber is increased simultaneously with the opening of the fuel feed door rather than prior to the opening of the fuel feed door. The present invention is an improvement over these prior art devices because it increases the air supply to the combustion chamber before the fuel feed door is opened without requiring interconnecting linkage.

SUMMARY OF THE INVENTION

An improved stove or heater is disclosed having an inner combustion chamber housing enclosed within an outer housing or cabinet, the outer cabinet having a cabinet door which provides access to a fuel loading door which in turn provides access to within the combustion chamber and permits fuel to be introduced therein. During normal operation of the stove or heater, the rate of combustion is regulated by a thermostatic damper which varies the supply of air to the combustion chamber. Since the supply of air to the combustion chamber is restricted, the sudden introduction of a large quantity of air into the combustion chamber results in a rapid increase in the rate of combustion. Consequently, unless prior to the opening of the fuel loading door the air supply to the combustion chamber is increased, the opening of the fuel loading door will result in the sudden admission of air into the combustion chamber thereby rapidly increasing the rate of combustion and frequently causing flames, smoke and other products of combustion to issue from the combustion chamber through the open fuel loading door.

The present invention comprises an air inlet into the combustion chamber positioned so as to be restricted by a pan member on the outer cabinet door when the cabinet door is closed. When the cabinet door is closed, air intake into the combustion chamber is provided via other air intake means controlled by a thermostat and draft regulator, as is known in the art. Upon opening the cabinet door, however, the air inlet is not restricted and additional air is supplied to the combustion chamber. Since the cabinet door must be opened to gain access to the fuel loading door, the air supply to the combustion chamber is always increased prior to opening the fuel loading door. Upon closing the fuel loading door and the cabinet door, the air inlet is again restricted and the air intake into the combustion chamber limited to other air intake means.

It is a primary object of the present invention to reduce the amount of flames, smoke and other products of combustion which blow back from the combustion chamber of a stove or heater through the fuel loading door when the fuel loading door is opened.

It is a further objection of this invention to eliminate or reduce the amount of flames, smoke and other products of combustion which blow back through the fuel loading door when the fuel loading door is opened without requiring any movable interconnecting linkage between the cabinet door or the fuel loading door and a closure member which normally restricts the flow of air into the combustion chamber.

These and other objects, advantages and features will hereinafter appear, and for the purpose of illustration, but not of limitation, an exemplary embodiment of the present invention is illustrated in the accompanying drawings.

DETAILED DESCRIPTION OF THE PREFERRED EMBODIMENT

Figure 1:
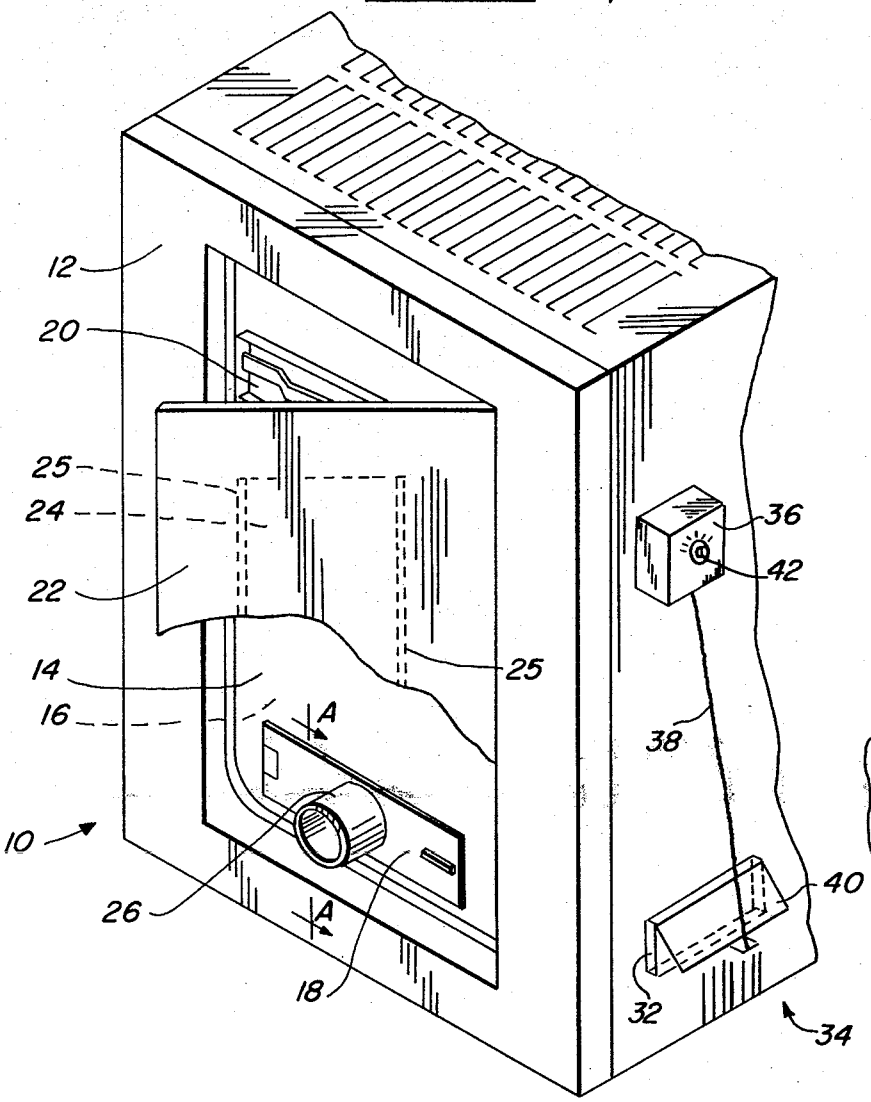
FIG. 1 is a fragmentary perspective view of the present invention.

With reference to FIG. 1, a stove or heater unit 10 embodying the present invention is shown. An outer housing 12 on the stove 10 encloses an inner combustion chamber housing 14 which contains the combustion chamber 16. The inner combustion chamber housing 14 has a pivotably mounted ash pit door 18 for providing access to the cumbustion chamber 16 whereby ashes can be removed. An air inlet 26 for supplying air to the combustion chamber 16 is rigidly mounted in the ash pit door 18. The inner combustion chamber housing 14 also has a pivotably mounted fuel loading door 20 (only partially shown) for providing access to the combustion chamber 16 whereby fuel can be introduced into the combustion chamber 16. A pivotably mounted cabinet door 22 in the outer housing 12 is located so as to provide access through outer housing 12 to both the ash pit door 18 and to the fuel loading door 20. A substantially U-shaped pan member 24 having flange members 25 is rigidly mounted on the cabinet door 22, as by spot welding.

Figure 2:
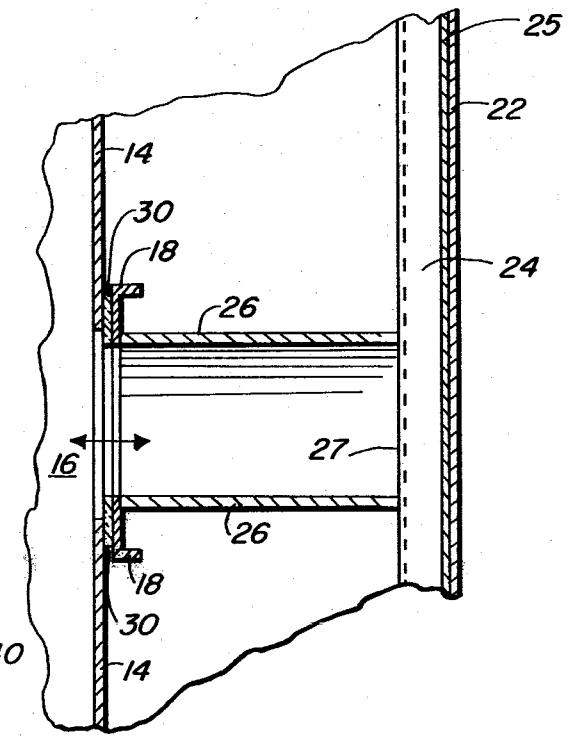
FIG. 2 is a partial cross-sectional view taken substantially along line A—A in FIG. 1 showing the air inlet of the present invention with the cabinet door closed.

With reference to the partial cross-sectional view shown in FIG. 2, a substantially air-tight seal between the ash pit door 18 and the periphery of air inlet 26 is provided by insulating material 30. However, a passage for air through ash pit door 18 and inner combustion chamber housing 14 into the combustion chamber 16 is provided by air inlet 26 via its end opening 27 when cabinet door 22 is open. It is seen that when the cabinet door 22 is closed, the air inlet 26 is substantially blocked by the pan member 24. The pan member 24 and the air inlet 26 are dimensioned so that the pan member 24 fits flush against the end opening 27 of the air inlet 26 when the cabinet door 22 is closed, thereby blocking the flow of air through air inlet 26.

Additional air intake means 32 controlled by a thermostatic damper 34 supplies air to the combustion chamber at a controlled rate when the cabinet door 22 is closed. The thermostatic damper 34 is comprised of a thermostat control assembly 36, which is connected by a chain 38 to a draft regulator door 40. Draft regulator door 40 is hinged over the opening to the additional air intake means 32. Thermostatic damper 34 is used to maintain a desired room temperature as selected by adjustment of a control knob 42 of the thermostat control assembly 36. When the room temperature falls below the temperature selected by control knob 42, thermostat control asembly 36 raises chain 38 to open draft regulator door 40 farther to thereby increase the air supplied through air intake means 32 and consequently the rate of combustion of heater unit 10. Similarly, as the room temperature increases to the temperature selected by control knob 42, thermostat control assembly 36 lowers chain 38 to close draft regulator door 40 farther to thereby decrease the air supplied through air intake means 32 and consequently the rate of combustion of heater unit 10.

Therefore, the stove 10 embodying the present invention burns fuel at a controlled rate when the cabinet door 22 is closed and pan member 24 is blocking air inlet 26. However, whenever the cabinet door 22 is opened the pan member 24 is moved away from its position in front of the air inlet 26 thereby allowing additional air to flow through the air inlet 26 into the combustion chamber 16. The rate of combustion in the combustion chamber 16 thus increases to a maximum level so that the admission of additional oxygen by the opening of either the fuel loading door 20 or the ash pit door 18 will not further affect the rate of combustion within the combustion chamber 16. Consequently, the flames, smoke and other combustion products are substantially contained within the combustion chamber 16 when either the fuel loading door 20 or the ash pit door 18 is opened.

While the preferred embodiment of the invention has been illustrated and described, it is to be understood that the invention is not to be limited to the precise construction herein disclosed, and the right is reserved to all changes and modifications coming within the scope of the invention as defined in the appended claims.

I claim:

1. In a heating unit having a combustion chamber enclosed within an outer housing, apparatus for preventing blow back, comprising:

a first door for providing access to the combustion chamber, said first door being movable between a closed and an open position;

a second door for providing access through the outer housing to said first door, said second door being movable between a closed and an open position;

a first air inlet for supplying air to the combustion chamber;

a thermostatic damper for controlling the rate of combustion in the combustion chamber by restricting the quantity of air supplied to the combustion chamber via said first air inlet;

a second air inlet for providing an air passage to the combustion chamber; and closure means rigidly mounted on said second door, said closure means being dimensioned to block said second air inlet when said second door is closed, said closure means being positioned to restrict the flow of air through said second air inlet when said second door is in the closed position and to allow air to flow into the combustion chamber through said second air inlet when said second door is not in the closed position, whereby a substantial quantity of air is permitted to flow into the combustion chamber when said second door is opened before said first door to the combustion chamber is opened.

2. The apparatus as claimed in claim 1 further comprising:

an ash pit door in the side of the combustion chamber for providing access for removing ashes from the combustion chamber, wherein said second air inlet is mounted in said ash pit door.

3. The apparatus as claimed in claim 1 wherein said closure means comprises a pan member mounted on the inside surface of said second door.

4. In a heating unit having a combustion chamber within an outer housing, apparatus for preventing blow back, comprising:

a pivotably mounted fuel loading door for providing access to the combustion chamber, said fuel loading door being movable between a closed an an open position;

a pivotably mounted cabinet door in the outer housing for providing access to said fuel loading door, said cabinet door being movable between a closed an an open position;

a first air inlet for supplying air to the combustion chamber;

a thermostatic damper for controlling the rate of combustion in the combustion chamber by restricting the quantity of air supplied to the combustion chamber via said first air inlet;

a second air inlet for providing an air passage into the combustion chamber, said second air inlet having a first end outside of the combustion chamber and a second end inside of the combusiton chamber; and a pan member rigidly mounted on the inside surface of said cabinet door, said pan member being dimensioned to fit against the first end of said second air inlet when said cabinet door is in the closed position to restrict the flow of air through said second air inlet when said cabinet door is in the closed position and to allow air to flow into the combustion chamber through said second air inlet when said cabinet door is not in the closed position.

5. The apparatus as claimed in claim 4 further comprising:

an ash pit door in the side of the combustion chamber for providing access for removing ashes from the combustion chamber, wherein said second air inlet is mounted in said ash pit door.

6. In a heating unit having a combustion chamber enclosed within an outer housing, apparatus for preventing blow back comprising:

a first door for providing access to the combustion chamber, said first door being movable between a closed and an open position;

a first air inlet for supplying air to the combustion chamber;

a thermostatic damper for controlling the rate of combustion in the combustion chamber by restricting the quantity of air supplied to the combustion chamber via said first air inlet;

a second air inlet for providing an air passage to the combustion chamber; and a second door for providing access through the outer housing to said first door, said second door being movable between a closed and an open position, and said second door being positioned so that when it is in the closed position the inside surface of said second door blocks said second air inlet to prevent the flow of air through said second air inlet into the combustion chamber and so that when said second door is not in the closed position said second air inlet is not blocked by the inside surface of said second door and air is allowed to flow through said second air inlet into the combustion chamber, whereby a substantial quantity of air is permitted to flow into the combustion chamber when said second door is opened before said first door to the combustion chamber is opened.

* * * * *